United States Patent [19]

Peters et al.

[11] 3,982,973

[45] Sept. 28, 1976

[54] CUBE TEXTURED NICKEL

[75] Inventors: Dale Thompson Peters, Mahwah; Gary Dale Sandrock, Ringwood, both of N.J.; Ernest Lee Huston, Suffern, N.Y.

[73] Assignee: The International Nickel Company, Inc., New York, N.Y.

[22] Filed: Dec. 11, 1975

[21] Appl. No.: 639,812

[52] U.S. Cl. ..... 148/32; 29/420.5; 75/170; 148/11.5 N; 148/31.55; 148/120; 148/122; 148/126

[51] Int. Cl.[2] ..... C22C 19/03; C22C 19/08; C21D 9/46

[58] Field of Search ..... 148/11.5 N, 120, 121, 148/122, 31.55, 32, 126; 75/170; 29/420.5

[56] References Cited

UNITED STATES PATENTS 2,506,393 5/1950 Smolochowski ..... 148/11.5 N X 2,519,495 8/1950 Nesbitt et al. ..... 148/11.5 N X

OTHER PUBLICATIONS

Barrett, C. S. et al., "The Structure of Metals", 3rd. Ed., (1966), McGraw Hill, Ch. 21, p. 570.

Jones et al., "Calculated and Observed Effects of Texture on the Magnetic Properties and Youngs Modulus of Nickel Sheet", Brit. Jour. of App. Phys., May 1958, vol. 9, pp. 178–184.

Bieker et al., "The Melting of Malleable Ni and Ni Alloys", Trans. AIME, 6/61, pp. 629–636.

*Primary Examiner*—Arthur J. Steiner

*Attorney, Agent, or Firm*—George N. Ziegler; Ewan C. MacQueen; Raymond J. Kenny

[57] ABSTRACT

Cube textured nickel strip produced by process of working and heat treating sulfur-containing nickel metal billets having specially controlled composition and grain size.

10 Claims, No Drawings

CUBE TEXTURED NICKEL

The present invention relates to ferromagnetic materials and more particularly to nickel metal (including high-nickel alloy) products that are specially processed to provide anisotropic magnetic characteristics.

It is well known that many of the magnetic characteristics of ferromagnetic metals, such as iron or nickel or alloys based thereon, that have been processed to be crystallographically textured are anisotropic and that magnetic anisotropy can be beneficial for magnetic use, including magnetostrictive use. Cube-on-face, (100) [001], oriented materials, referred to herein as "cube textured", can provide desirably high magnetostriction. Moreover, crystallographically oriented metal sheet in magnetostrictive cores can benefit, inter alia, power density capability, linearity of response at high power levels and range of resonant frequency.

Cube textured nickel sheet or strip has been produced heretofore on a laboratory scale for research purposes by taking advantage of great purity of the metal under laboratory control. Yet, inasmuch as nickel is known to have magnetic characteristics of utility for instruments, machines and other devices that are desired to be made in production on a commercial scale, it is desirable to benefit from the anisotropy of cube textured nickel while tolerating small amounts of impurities, e.g., sulfur, that are often present or introduced in nickel processed under commercial production conditions.

The presence of cube texture may be inferred from optical micrographic inspection of dislocation etch pits, X-ray diffraction analysis by $2\theta$-scans or pole figures, or primary magnetization curves. To quantify the degree of cube texture, Young's elastic modulus, saturation magnetostrictive strain, sound velocity and the first anisotropy constant derived from the magnetic torque curve characterizing polycrystalline material, also referred to herein as $K_{1p}$, may be measured. Measurement of magnetocrystalline anisotropy and other physical properties are discussed with more particulars in our paper relating to cube textured nickel in IEEE Transactions on Magnetics, Vol. MAG-9, No. 4, December 1973, pp. 636–640.

There has now been discovered a process beneficial for producing nickel products reliably and consistently in the desired cube textured condition.

It is an object of the invention to provide a process for preparing cube textured nickel products.

Another object of the invention is to provide a cube textured nickel product.

The present invention contemplates a process comprising providing a nickel billet having the fine-grain condition characterized by an average grain size up to 0.08mm (millimeter), advantageously not greater than 0.03mm, and having a composition containing sulfur in a weight proportion of 0.0002% (2ppm) to about 0.003% sulfur, up to about 6% cobalt, up to 0.10% carbon, advantageously not exceeding 0.05% carbon, at least one ingredient from the group consisting of 0.1% to 0.5% iron, 0.1% to 0.5% manganese, 0.01% to 0.1% in total of the rare earth metals lanthanum and neodymium, 0.001% to 0.1% calcium and combinations thereof, with balance essentially nickel, provided that the billet metal contain at least one of the ingredients rare earth metals and calcium, advantageously 0.02% to 0.06% calcium, when the sulfur content of the metal is 8ppm or more, cold working the billet metal by at least 95% reduction in thickness to form strip having a thickness of up to about 0.25mm, heating the cold worked strip in the range of about 800°C to about 1260°C, advantageously 980°C to 1260°C, provided that the heating be in the range of 900°C to 1100°C when the rare earth ingredient is present and the iron, manganese and calcium ingredients are absent, in a nonoxidizing atmosphere for a time sufficient to anneal and recrystallize the cold-worked metal to the primary recrystallized cube texture condition and then cooling the recrystallized metal sufficiently rapidly to maintain the primary recrystallized cube texture condition and prevent secondary recrystallization. The grain structure of cube textured products resulting form the process is uniformly fine-grained generally averaging about 0.02mm to 0.08mm.

Control of production practices according to the process parameters, e.g., billet chemistry, penultimate grain size, cold rolling reduction and annealing treatment, for the invention provides special advantages of reliability and consistency for obtaining desired cube texture in sulfur-containing nickel, albeit cube texture may occasionally occur without the process of the invention.

Annealing temperatures of at least 980°C are advantageous for thoroughly recrystallizing the metal to the desired cube texture, and annealing treatments having the metal temperature in this upper portion of the annealing range for restricted period of 20 minutes to 3 minutes are recommended for obtaining desired cube texture and avoiding detrimental secondary grain growth. At the lower annealing temperatures, such as 815°C, the annealing period can extend to longer times of about 1 or 2 hours. Control of annealing to avoid exceeding 1260°C and to avoid long times near the high temperatures, such as ½-hour at 1204°C, is an important aid in ensuring against detrimental secondary recrystallization.

It is also important to terminate the heating in the annealing temperature range, and to cool the metal down below the annealing range, preferably cooling to about 500°C or lower, before secondary recrystallization (sometimes referred to as abnormal grain growth) destructive to the desired cube texture is initiated. Maintaining non-oxidizing atmosphere protection during cooling from annealing temperatures is beneficial for avoiding uncontrolled oxidation of the metal, albeit a subsequent oxidation of the surfaces may be desired, e.g., to provide a dense and tightly adherent oxide insulating film.

Cooling at ordinary rates of air or radiant cooling is satisfactory.

Surface oxidation treatments should be controlled to not exceed about 900°C in order to avoid excessively rapid oxidation rates that would result in unsatisfactory thick oxide scales. Surface oxidation heat treatments can be done before or after the recrystallization anneal. Although some cube texture may be formed during a surface oxidation treatment, an anneal in the high anneal range is advantageous for fully achieving the benefits of cube texture.

The controlled composition of the billet provided in the process of the invention provides important benefits of achieving consistently good results while tolerating certain elements that are likely to be present and/or introduced into metal products when production is carried out on a large commercial scale where ultra high-purity control of laboratory scale practice is impractical. In the present invention the special amounts of the process agents iron, manganese, calcium, lanthanum and neodymium are especially beneficial toward providing satisfactory cube texture in presence of small amounts of sulfur that are difficult or impractical to avoid in commercial-grade raw materials, heating fuels and machine lubricants.

The grain size of the billet metal at the beginning of the cold working to 95% or more reduction in thickness is referred to herein as the penultimate grain size. In the process of the invention, penultimate grain size is controlled to not exceed 0.08mm, and is advantageously not greater than 0.03mm, in order to obtain good cube texture. Unsatisfactory textures with coarse secondary grains, or duplex mixtures of primary and secondary grains, have resulted when penultimate grain size was excessively large, e.g., 0.12mm.

The metal billet can be prepared by working an ingot of the metal, advantageously with calcium, to form a billet of the required penultimate grain size and of dimensions and shape suitable for the 95% cold-rolling to the required final thickness. Hot rolling temperatures for the billet are preferably low, not higher that 871°C, and more preferably about 760°C. Other satisfactory means for preparing the billet include compacting and sintering nickel powder, advantageously with iron or manganese, and hot rolling to form a billet of sufficient soundness and density, e.g., at least 95% the density of melted and solidified nickel, for enabling subsequent cold rolling. Particle size of the powder and of the sintered billets should not exceed the penultimate grain size required for billets. Also, and desirably, a sintered compact may be cold worked to provide the billet and further cold worked to strip in instances where sintered compacts of satisfactory size, soundness and structure, and suitable cold working apparatus are available. A sintered billet thickness of about 13mm is advantageous for avoiding need for hot working and for enabling the high amount of cold reduction to be obtained in sheets of up to 0.25mm final thickness.

Characteristics that show satisfactory cube texture in nickel metal strip resulting from the process of the invention include sound velocity not greater than 4000 m/sec (meters per second) when measured at room temperature in the direction of rolling, at least 75% reduction of the intensity of the (220) and (311) peaks measured by X-ray diffraction $2\theta$-scan when compared to a randomly oriented polycrystalline standard, and an X-ray diffraction intensity ratio R of at least 15.

Generally, sound velocities in the strip products are in the range of 3700 m/sec to 4000 m/sec. (meters per second).

The X-ray intensity ratio R referred to herein is computed from X-ray intensity values of the (200) and the (111) peaks from the specimen and from the standard of random orientation (loose, randomly oriented, nickel powder). An R value of 1.0 characterizes random orientation and R values of 15 and higher characterize good cubic texture.

Algebraically, $$R = \frac{\frac{(I_{200})}{(I_{111})}\text{Spec.}}{\frac{(I_{200})}{(I_{111})}\text{Std.}}$$

Two characteristics, the first anisotropy constant, $K_{1p}$, and the saturation magnetostriction strain $\lambda$, are effected by cobalt content of the metal composition. Generally, with a satisfactory cube texture in the product, $K_{1p}$ of the product is at least 72% of the $K_{1p}$ value measured in the (100) plane of a single crystal of the same metal composition (−52,000 ergs/cm$^3$ for pure nickel). With up to 0.1% cobalt, $K_{1p}$ values of −37,500 ergs/cm$^3$ (ergs per cubic centimeter) and greater (higher negative) are obtained. $K_{1p}$ values greater than, i.e., more negative than, minus 45,000 ergs/cm$^3$ are characteristic of especially good cube textures of nickel with at least 85% cube orientation. When cobalt content is increased above 0.1%, the $K_{1p}$ value is descreased, even when the product is cube textured. Saturation magnetostrictive strain measured by the 90° rotation technique is at least $-50\times10^{-6}$ for products containing up to 0.1 cobalt, but decreases to lower values as the cobalt content is increased, e.g., $-46\times10^{-6}$, but not below $-44\times10^{-6}$ when the cobalt content is increased to about 4.5%.

Among other things, the invention provides cold rolled and annealed nickel metal strip products of thickness up to about 0.25 millimeters, a composition consisting essentially of 0.0002% to about 0.003% sulfur, up to about 6% cobalt, up to 0.1% carbon, at least one ingredient from the group consisting of 0.1% to 0.5% iron, 0.1% to 0.5% manganese, 0.01% to 0.1% in total of the rare earth metals lanthanum and neodymium, 0.001% to 0.1% calcium, and mixtures thereof, provided that when the product metal contains at least 0.0008% sulfur the product metal also contain at least one of the rare earth metals and calcium ingredients, with balance essentially nickel and characterized by, inter alia, a sound velocity in the metal parallel to the direction of cold rolling of up to 4000 meters per second (at room temperature).

Herein, metal strip products refers to products made by lengthwise (unidirectional, which may be with 180° reversal) cold rolling of metal to thin shapes, including strip, sheet, foil and the like. Generally, for most practical utility, the strip product has thickness of about 0.1 to 0.25mm and grin size of about 0.02 to 0.08mm. Iron and manganese are often about 0.2%, or 0.1%, to 0.3%, individually or in combination.

For ensuring obtaining desired physical characteristics, the amount of any carbon in the strip product is controlled to avoid exceeding 0.1% carbon, more assuredly not more than 0.05% or no more than 0.02% carbon, with control over matters including source materials, melting and sintering practices and annealing treatments. Contact with materials and atmospheres that may tend to introduce carbon, or sulfur or other impurities, should be prevented or restricted insofar as is practical, even though the present process provides a beneficial tolerance for restricted amounts of impurities.

For purposes of providing those skilled in the art some more particular illustrations of the invention and advantages thereof, the following examples are set forth.

EXAMPLE I

Nickel powder having typically a particle size of about 4 to 7 microns (Fisher Sub-Sieve size), apparent density 2.0 to 2.7 g/cc (grams per cubic centimeter), carbon content 0.05% to 0.1%, sulfur less than 0.001% and balance high purity nickel, type 123, was blended with 1/4% iron powder and isostatically compacted at room temperature at 30,000 pounds per square inch pressure (207 megapascal) and then sintered 1½ hours at 704°C plus 4 hours at 1177°C in dry hydrogen. The iron powder was low-sulfur, low carbon iron of 3 to 5 microns. The sintered compact was hot rolled at 871°C from a 5.7cm diameter sintered compact size to a 6.4mm thick plate billet without intermediate annealing. Penultimate grain size was 0.02mm. Metal of the billet was cold-rolled 96.5% to 0.22mm strip (strip 1). A portion of the cold rolled strip was annealed in dry hydrogen for 6 minutes at 1200°C, thereby recrystallizing the cold-rolled strip to the fine grain, primary recrystallized, annealed condition, and was then cooled to room temperature, thus resulting in a cube-textured nickel product having a fine-grain primary-recrystallized structure with grain size not greater than 0.8mm. Cooling was done by moving the metal, after the 0.1 hour anneal, to a cool zone in the protective atmosphere chamber, holding there for radiation cooling down to about 500°C, and thereafter taking the annealed product out into the air. Results of chemical analysis and of torque magnetometry to measure the $K_{1p}$ characteristic of product 1 are set forth in the following Table in units of ppm (weights parts per million), % (weight percentages) and ergs/cm$^3$ (ergs per cubic centimeter). Achievement of a good cube texture was confirmed with a $K_{1p}$ test result of −46,530 ergs/cm$^3$ set forth in the Table along with chemical analysis and physical characteristics pertaining to product 1.

EXAMPLE II

Nickel powder was blended with an addition of 1/4% manganese powder and compacted, sintered and hot-rolled as in Example I to 6.4mm thick plate, providing billet 2 with penultimate grain size of 0.014mm. The manganese powder was minus 325 mesh with 0.06% carbon and 340ppm sulfur, although a lower sulfur content would have been preferred. The billet was cold rolled 96.4%, resulting in 0.23mm thick strip 2, which was recrystallization annealed 6 minutes at 1200°C and cooled by practices of Example I, to provide product 2. Particulars pertaining to product 2, including a $K_{1p}$ test result of −45,830 ergs/cm$^3$ which confirmed attainment of a good cube texture, are set forth in the Table that follows.

EXAMPLE III

A nickel powder mixture containing 1/4% of manganese powder was isostatically compacted at 207 megapascals, sintered 1½ hrs. at 704°C plus 4 hours at 1177°C in dry hydrogen and hot rolled without intermediate anneals to a ¼-inch thick billet. Hot rolling started with a 1-inch thick compact at a 1149°C soaking temperature and proceeded at temperatures several hundred degrees lower due to strong chilling effects of the rolls. Penultimate grain size was about 0.08mm. Metal of the billet was cold rolled 96.9% to 0.20mm strip, annealed at 1200°C for 0.1 hour and then radiation cooled in dry hydrogen, resulting in cube-textured nickel product 3. Particulars of product 3 and the processing thereof are set forth in the Table.

EXAMPLE IV

A nickel powder mixture containing 1/4% iron powder and 1/4% manganese powder was compacted, sintered and hot rolled, then 96.8% cold rolled to 0.2mm strip (strip 4), annealed and cooled according to the procedures of Example III. This process produced cube textured nickel product 4, chemical analysis and physical characteristics of which are set forth in the Table.

A different, excessively long-time, anneal of another specimen of strip 4 for 0.5 hour at 1200°C resulted in an unsatisfactory structure with large secondary grains.

EXAMPLE V

A vacuum-induction melt containing 25ppm sulfur and balance essentially nickel was made from previously obtained sulfur-containing nickel remelt stock. After a carbon boil in vacuum, for deoxidation, the vacuum chamber was back-filled with argon to a pressure of about ½ atmosphere. While under argon, the melt was treated with an addition of 0.1% calcium, as 90 Ni/10Ca, and cast to ingot form. The ingot metal was reheated to 871°C and hot rolled to about 80% reduction in thickness and provided a billet with 0.014mm penultimate grain size. Then metal of the billet was cold-rolled 97% to 0.20mm strip. No intermediate anneals were employed. Specimens of the 97% cold-rolled strip were hydrogen annealed 0.1 hour at 1200°C and cooled according to procedures of Example I. Micrographic examination showed that the annealed product 5 had recrystallized to a fine-grain structure having 0.057mm grain size without any secondary recrystallization. A $K_{1p}$ test result of −48,790 ergs/cm$^3$ from product 5 confirmed that the processing had resulted in satisfactory cubic texture. Chemical composition and other particulars pertaining to product 5 are set forth in the Table.

Annealing another specimen of the 0.2mm strip of this example for 2 hours at 1200°C also resulted in satisfactory cube texture, evidenced by a fine grained primary recrystallized structure, with no evidence of secondary recrystallization, and a $K_{1p}$ value of −46,300 ergs/cm$^3$.

EXAMPLE VI

A vacuum-induction melt containing 25ppm sulfur and balance essentially nickel was made, treated with an addition of 0.1% misch metal while in an argon atmosphere, then cast, hot-rolled cold-rolled, and hydrogen annealed at 1100°C by the practices used for making the calcium-containing strip of Example V, except that about one-third of the penultimate grain structure was not recrystallized and the anneal was at 1100°C, instead of 1200°C. The process of this Example VI with the misch metal treatment resulted in product 6, which contained lanthanum and neodymium along with a residue of cerium from the misch metal. The $K_{1p}$ test result for product 6 was −43,000 ergs/cm$^3$ and showed that cube texture characteristics of product 6 were acceptable, but not as beneficial as those of products 1 through 5. For the present invention, strip made of melted nickel treated with lanthanum and neodymium, without a calcium addition, is annealed at 900°C to 1100°C. $K_{1p}$ test results from other portions of strip 6 that were annealed at lower and higher temperatures were unsatisfactorily low, e.g., −35,000 ergs/cm$^3$ and lower (less negative).

TABLE

| Product No. | S ppm | Fe % | Mn % | Ca % | C % | Other % | Penult. G.S. (mm) | Final G.S. (mm) | % Cold Red'n. | Final Thick. (mm) | $(K_1)_{poly}$ (ergs/cm³) |
|---|---|---|---|---|---|---|---|---|---|---|---|
| 1 | 4.2 | 0.24 | 0.001 | 0.001 | 0.005 | — | 0.020 | <0.08 | 96.5 | 0.22 | −46,530 |
| 2 | 4.9 | NA | 0.23 | 0.0005 | 0.005 | — | 0.014 | — | — | 0.23 | −45,830 |
| 3 | 3.0 | 0.007 | 0.23 | NA | 0.008 | — | — | — | 96.9 | 0.20 | −45,370 |
| 4 | 3.0 | 0.22 | 0.22 | NA | 0.007 | — | — | — | 96.8 | 0.20 | −47,880 |
| 5 | 15 | 0.011 | NA | 0.052 | 0.006 | — | 0.014 | 0.057 | 97.0 | 0.20 | −48,790 |
| 6 | 24 | 0.048 | NA | NA | 0.005 | 0.027La * 0.01 Nd * | 0.01 ** | 0.06 | 97.0 | 0.20 | −43,000 |

Na — Not Added and Not Analyzed
ppm — parts per million, by weight
* — presence resulting from addition of 0.1% mischmetal; 0.04% Ce also present
** — not completely recrystallized
% — percent by weight Attempts to produce cube texture by cold rolling and annealing melted nickel to which cerium had been added alone, without lanthanum and neodymium, and to which magnesium had been added (and which had 25 ppm sulfur, and carbon contents of 0.006% and 0.055% respectively) resulted in rapid secondary grain growth and failed to produce satisfactory cube textures and thus indicated that cerium and magnesium are not satisfactory substitutes for calcium or the rare earth metals lanthanum and neodymium in making melted products according to the process of the invention.

In view of the success with the misch metal addition of Example VI, it is to be understood that presence of cerium in amounts such as 0.04% can be tolerated and does not inevitably prevent successful operation of the invention.

The present invention is particularly applicable to providing crystallographically textured, cube-on-face (100) [001] oriented, core materials for magnetostrictive transducers, including acoustic sound generators. Among other things, the invention can be especially beneficial in the production of large magnetostrictive cores in acoustic generators of low frequency underwater sound. Machines, instruments and other devices wherein cube textured nickel provided by the invention may be useful include active and passive sonar devices, ultrasonic cleaners, ultrasonic drills, ultrasonic soldering tanks and ultrasonic atomizers.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

We claim:

1. A process comprising providing a billet of metal having the fine-grain condition characterized by an average grain size up to 0.08 millimeter and having a composition consisting essentially of 0.0002% to about 0.003% sulfur, up to about 6% cobalt, up to 0.10% carbon, at least one ingredient from the group consisting of 0.1% to 0.5% iron, 0.1% to 0.5% manganese, 0.01% to 0.1% in total of the rare earth metals lanthanum and neodymium, 0.001% to 0.1% calcium and combinations thereof, with balance essentially nickel, provided that when the billet metal contains at least 0.0008% sulfur the billet metal also contain at least one of the rare earth metals and calcium ingredients, cold working the billet metal unidirectionally to reduce the thickness at least 95% and form the metal to strip having a thickness of up to about 0.25 millimeter, heating the cold worked strip in a nonoxidizing atmosphere in the temperature range of about 800°C to about 1260°C, provided that the heating be in the range of 900°C to 1100°C when the rare earth ingredient is present and the iron, manganese and calcium ingredients are absent, for a time sufficient to anneal and recrystallize the metal to the primary recrystallized cube texture condition and then cooling the recrystallized metal sufficiently to maintain the primary recrystallized cube texture condition and prevent secondary recrystallization.

2. A process as set forth in claim 1 wherein the average grain size of the billet is up to 0.03 millimeters.

3. A process as set forth in claim 1 wherein the carbon content of the billet metal is up to 0.05% carbon.

4. A process as set forth in claim 1 wherein the temperature of heating the cold worked strip is at least 980°C.

5. A process as set forth in claim 4 wherein the period of heating the cold worked strip is 3 minutes to 20 minutes.

6. A process as set forth in claim 1 wherein the billet is a compacted and sintered powder metal billet that contains 0.1% to 0.5% of metal from the group iron, manganese and mixtures thereof.

7. A process as set forth in claim 1 wherein the billet is a melted, cast and rolled metal billet containing 0.02% to 0.06% calcium.

8. A process as set forth in claim 1 wherein the billet is a melted, cast and rolled metal billet containing 0.01% to 0.1% in total of metal from the group lanthanum and neodymium and wherein the temperature of heating the cold worked strip is in the range of 900°C to 1100°C.

9. A cold-rolled and cube-textured nickel metal strip product having a thickness up to about 0.25 millimeters, a composition consisting essentially of 0.0002% to about 0.003% sulfur, up to about 6% cobalt, up to 0.1% carbon, at least one ingredient from the group consisting of 0.1% to 0.5% iron, 0.1% to 0.5% manganese, 0.01% to 0.1% in total of the rare earth metals lanthanum and neodymium, 0.001% to 0.1% calcium, and mixtures thereof, provided that when the product metal contains at least 0.0008% sulfur the product metal also contain at least one of the rare earth metals and calcium ingredients, with balance essentially nickel and characterized by a second velocity in the metal parallel to the direction of cold rolling of up to 4000 meters per second, said strip product having been heated in a non-oxidizing atmosphere in the temperature range of about 800°C to about 1260°C, provided that the heating having been in the range of 900°C to 1100°C when the rare earth ingredient is present and the iron, manganese and calcium ingredients are absent, for a time sufficient to anneal and recrystallize the metal, said strip product having been subsequently cooled sufficiently to maintain the primary recrystallized cube texture condition and prevent secondary recrystallization.

10. A product as set forth in claim 9 containing up to 0.1% cobalt and further characterized by a $K_{1p}$ value of minus 37,500 ergs per cubic centimeter or more negative.

* * * * *